United States Patent [19]

Soderquist et al.

[11] Patent Number: 4,886,431

[45] Date of Patent: Dec. 12, 1989

[54] PERISTALTIC PUMP HAVING INDEPENDENTLY ADJUSTABLE CARTRIDGES

[75] Inventors: Charles E. Soderquist; James P. Beck, both of Barrington, Ill.

[73] Assignee: Cole-Parmer Instrument Company, Chicago, Ill.

[21] Appl. No.: 188,286

[22] Filed: Apr. 29, 1988

[51] Int. Cl.[4] ..... F04B 43/12

[52] U.S. Cl. ..... 417/477; 604/153

[58] Field of Search ..... 417/474, 475, 476, 477; 604/153

[56] References Cited

U.S. PATENT DOCUMENTS

| | | | |
|---|---|---|---|
| 1,988,337 | 1/1935 | Santiago | 417/477 |
| 2,804,023 | 8/1957 | Lee | 103/149 |
| 3,366,071 | 1/1968 | Dutler | 103/149 |
| 3,402,673 | 9/1968 | Ballentine | 417/475 |
| 3,723,030 | 3/1973 | Gelfand | 417/475 |
| 3,791,771 | 2/1974 | Papoff et al. | 417/477 |
| 3,927,955 | 12/1975 | Spinosa et al. | 417/477 |
| 4,025,241 | 5/1977 | Clemens | 417/477 |
| 4,189,286 | 2/1980 | Murry et al. | 417/477 |
| 4,211,519 | 7/1980 | Hogan | 417/360 |
| 4,473,342 | 9/1984 | Iles | 417/360 |
| 4,552,516 | 11/1985 | Stanley | 417/477 |
| 4,673,334 | 6/1987 | Allington | 417/475 |

FOREIGN PATENT DOCUMENTS

| | | |
|---|---|---|
| 100309 | 11/1982 | Fed. Rep. of Germany . |
| 8204291 | 12/1982 | World Int. Prop. O. . |
| WO83101984 | 6/1983 | World Int. Prop. O. . |
| 1383858 | 2/1975 | United Kingdom . |
| 2076476 | 5/1981 | United Kingdom . |
| 2094410 | 7/1981 | United Kingdom . |

OTHER PUBLICATIONS

Cole-Parmer Instrument Company Catalog, 3 pgs., 1987-1988, includes p. 684.

*Primary Examiner*—Carlton R. Croyle
*Assistant Examiner*—D. Scheuermann
*Attorney, Agent, or Firm*—Fitch, Even, Tabin & Flannery

[57] ABSTRACT

A peristaltic pump having a plurality of removable cartridges, each containing a length of tubing, and each having means for adjusting occlusion comprising a linearly displaceable occlusion bed. Tubing retainers on each cartridge stabilize the tubing segments to constrain them against longitudinal displacement during pumping. Means are provided to enable visual determination of occlusion adjustment through the top of each cartridge. Each of the cartridges is reversible, and is readily installed on the pump frame and retained thereon by a snap-lock mechanism.

12 Claims, 2 Drawing Sheets

PERISTALTIC PUMP HAVING INDEPENDENTLY ADJUSTABLE CARTRIDGES

BACKGROUND OF THE INVENTION

The invention relates generally to a peristaltic pump and more particularly to a peristaltic pump for pumping fluid through a plurality of separate tubing segments simultaneously.

Peristaltic pumps with removable cartridges, i.e., cartridge pumps, are employed to pump fluid through a plurality of tubing segments simultaneously, permitting removal or addition of individual tubing segments from the pump. Some such pumps also provide for variable occlusion, i.e., variation of the distance between the rollers and the occlusion bed, to vary the extent to which the tubing disposed therebetween is compressed during pumping. One known arrangement for varying the occlusion involves angular displacement of the occlusion bed. The occlusion bed essentially pivots about a flexible portion of the cartridge frame.

Variability of occlusion is desirable as it enables "fine tuning" of flow rates. It is generally desirable that the degree of occlusion be approximately uniform along the length of the occlusion bed. Otherwise, the tubing may be overstressed at the area or areas of greatest deformation. A disadvantage of the above-described pivoting-bed mechanism is that it inherently produces non-uniform variations in occlusion along the length of the occlusion bed when pivoted.

It is a general object of the instant invention to provide an improved variable-occlusion cartridge pump.

Further objects and advantages are explained below.

SUMMARY OF THE INVENTION

In accordance with the present invention, there is provided a variable occlusion cartridge pump which enables approximately uniform variation of occlusion over the entire length of its occlusion bed by providing for substantially linear displacement of the occlusion bed, in substantially radial direction relative to the axis of the pump rotor. Manually operable adjustment means are provided to enable precise selection of the degree of occlusion by enabling precise displacement of the occlusion bed. Adjustment of the position of the occlusion bed is preferably provided by engagement of sloped surfaces on the occlusion bed by a pair of horizontally movable wedges. The positions of the wedges are controlled by an adjustment screw. Each wedge preferably includes a mass of elastomeric material frictionally engaging the screw and means for adjusting the frictional force between the elastomeric mass and the screw, to provide stability for the occlusion bed.

In the preferred embodiment of the invention, each of the cartridges has an indicator which permits viewing of a portion of at least one of the wedges from above, and includes a scale or other indicia juxtaposed with the wedge to facilitate visual determination of the position of the wedge.

In the preferred embodiment, tubing retainers are employed to prevent longitudinal displacement of the tubing during pumping. The preferred tubing retainers comprise movable members having V-shaped notches therein with surfaces engaging the tubing to provide positive engagement of the tubing without greatly reducing its internal diameter or cutting its outer surface.

DETAILED DESCRIPTION OF THE PREFERRED EMBODIMENT

Figure 4:
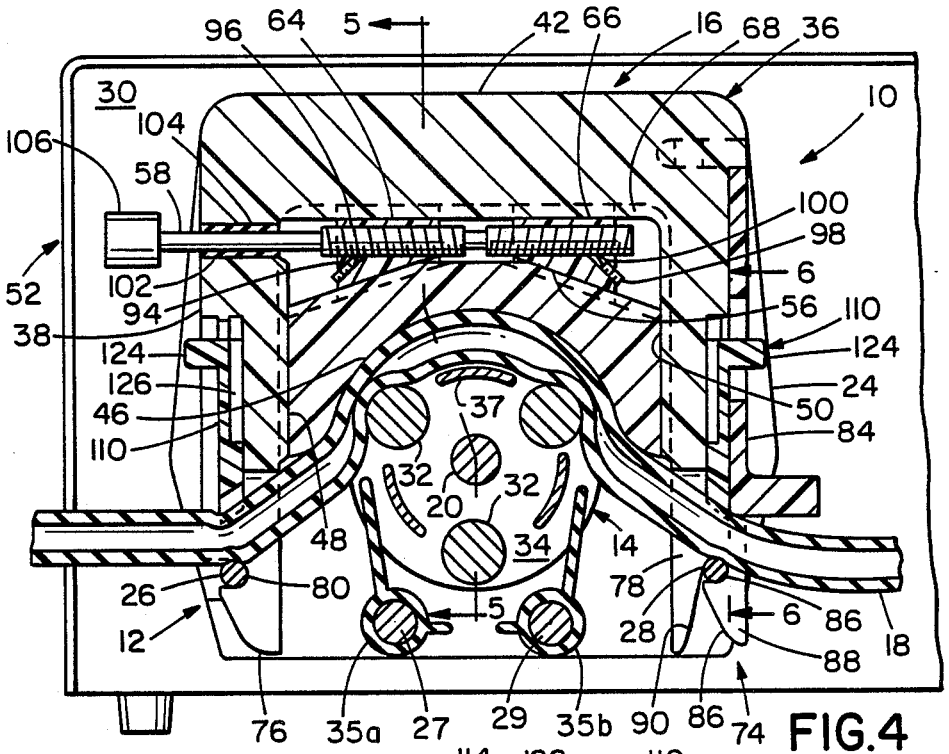
FIG. 4 is a sectional view taken substantially along line 4—4 in FIG. 1.
Figure 5:
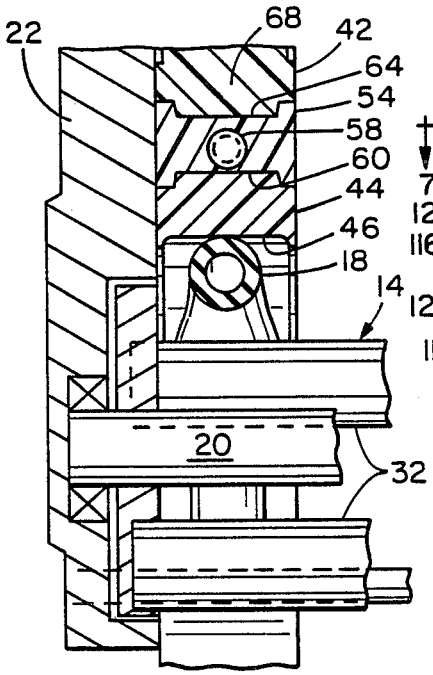
FIG. 5 is a sectional view taken substantially along line 5—5 in FIG. 4.
Figure 6:
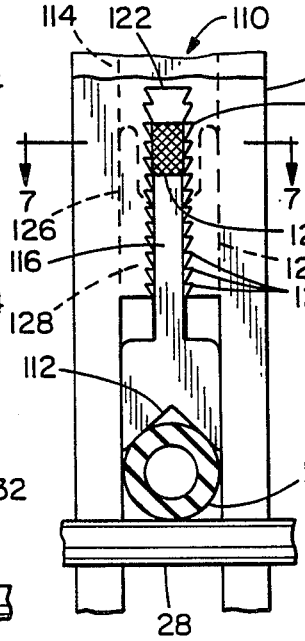
FIG. 6 is a sectional view taken substantially along line 6—6 in FIG. 4.
Figure 7:
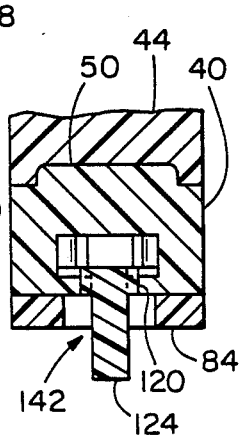
FIG. 7 is a sectional view taken substantially along line 7—7 in FIG. 6.

The preferred embodiment of the invention comprises a pump 10 which includes a frame 12, a rotor 14 supported for rotation on the frame, and a plurality of removable cartridges 16. Each of the cartridges 16 is adapted for supporting an individual segment of flexible tubing 18 in engagement with the rotor as shown in FIG. 4. Peristaltic pumping through the tubing is effected by rotation of the rotor.

The frame 12 comprises a pair of forward and rear end walls 22 and 24 and a plurality of substantially horizontal rods 26, 27, 28 and 29 connecting the end walls. The outer rods 26, 28 are positioned for cooperation with the cartridges 16 to maintain the cartridges in position on the frame as described below. The inner rods 27 and 29 are bolted to the end walls of the frame to provide rigidity for the frame. The rear wall 24 has means thereon for connecting the pump to a commercially available Masterflex ® pump controller 30 available from Cole-Parmer Instrument Co.

The rotor 14 extends between the end walls 22, 24, and has a coupling means thereon to enable connection to a motor-driven shaft of the controller 30. The rotor 14 includes a plurality of rollers 32 supported between a pair of end members 34 which are fixed to a shaft 20. Each roller 32 is carried in a circular path about the axis of the rotor, and additionally rotates about its own axis of rotation.

As a safety feature, the pump may include an elastomeric guard 35 which partially shields the lower portion of the rotor 14. The illustrated guard comprises a left member **35*a* and a right member 35*b*. Each of the members 35*a* and 35*b* comprises a tube which fits over a respective one of the rods 27, 29, and includes a first wall which extends upward, and a second wall which extends horizontally inward toward the opposite guard member. Both of the walls extend the entire distance between the end walls 22 and 24**.

The pump may also include additional guards 37 which are disposed between the rollers 32 and are coextensive therewith.

Each of the removable cartridges 16 comprises a three-sided frame 36 which includes first and second generally vertical side members 38 and 40, and a generally horizontal top member 42 connecting the side members. The frame is preferably a one-piece, integral, molded structure made of a suitable plastic. Each cartridge 16 further includes a generally horizontal occlusion bed 44 disposed between the side members 38, 40 and spaced from the top member 42.

The lower surface of the occlusion bed 44 comprises an arcuate pressure surface 46, which is configured in major part as a portion of a cylinder, for engaging the tubing 18. The pressure surface 46 is disposed at a predetermined radius from the rotor axis. The pressure surface 46 extends through an arc of greater than 120° so that, when a three-roller rotor is being used, as in the illustrated embodiment, at least one roller is compressing the tubing against the pressure surface at all times during operation. At its opposite ends, the pressure surface curves radially outwardly relative to the rotor to avoid unacceptable stress concentrations on the tubing and pump components as the rollers engage and disengage the portion of the tubing contacting the pressure surface.

In accordance with one aspect of the invention, to permit substantially uniform variation of occlusion along the pressure surface 46 of the occlusion bed 44, the occlusion bed 44 is vertically movable in rectilinear motion, being mounted in slidable engagement with the inner surfaces 48, 50 of the side members, and has its vertical position controlled by an adjustment mechanism 52. The top of the occlusion bed 44 is configured for camming engagement with a pair of wedges 54, 56 which are horizontally movable and which are in threaded engagement with an adjustment screw 58.

The adjustment screw 58 has a pair of threaded portions 70, 72 of opposite hand, one threaded portion being in engagement with each of the wedges, so that rotation of the adjustment screw drives the wedges in opposite directions. Each of the wedges has its lower surface inclined at an angle of about 20° to its horizontal upper surface. This provides a sufficient range of vertical displacement of the occlusion bed over the range of travel of the wedges while also providing an acceptable mechanical advantage in adjustment, and maintaining friction between the wedges and the outer surface of the occlusion bed within acceptable limits.

In the illustrated embodiment, oppositely sloping camming surfaces 60, 62 of the occlusion bed 44 slidably engage the respective wedges 54 and 56 in tongue-and-groove engagement. Also, each of the wedges has a groove 64, 66 on its upper surface for slidably engaging a projecting ridge 68 on the lower surface of the top 42 of the cartridge to provide a similar tongue-and-groove arrangement there. Thus, when upward pressure is exerted on the wedges by the occlusion bed, the wedges are constrained for rectilinear movement horizontally along a line extending between the side members 38, 40.

To provide for mounting of the cartridges on the pump frame 12, the cartridges have means for engaging the outer rods 26 and 28. The left side member 38 of the cartridge 16 has a pair of legs 76 extending downwardly at its lower end. The legs have aligned notches 80 therein for engaging one of the support rods 26. The opposite side member 40 has a locking mechanism 74 for engaging the other rod 28.

The locking mechanism 74 is formed by the combination of a pair of legs 78 having notches 82 therein which face generally outwardly and downwardly on the side member, defining an internal radius for engaging the rod 28, and a resilient, flexible member 84 having legs 88 with inwardly-facing notches 86 thereon for engaging the outer, lower surface of the rod 28.

The legs 78 and 88 have downwardly diverging camming surfaces 90, 92 formed thereon to facilitate locking of the cartridge 16 in place. The cartridge may be placed "on line" by first engaging the notches 80 on the left side legs 78 with one of the rods 26, and pivoting the cartridge downward until the resilient member 84 is cammed outwardly, then snaps back into its original position, locking the cartridge in place. A handle 91 is provided to facilitate manipulation of the cartridge 16.

To facilitate release of the locking mechanism, a lever 89 may be provided for camming the flexible member 84 outwardly. The illustrated lever 89 comprises a wire bail having its ends pivotally mounted on the side member 40 of the frame. The lever 89 has two side portions extending upwardly from the ends to a horizontal portion that extends across the width of the cartridge 16. Each of the side portions extends substantially vertically upward for a short distance, then curves through an obtuse angle to extend outwardly and upwardly over the handle 91. When the lever is pressed downwardly by the user into contact with the handle, the lower part of the lever cams the flexible member 84 outwardly.

The flexible member 84 is fixed to the adjacent portion of the cartridge frame by engagement between a pair of legs 134 at the upper end of member 84 and corresponding slots 136 in the frame; and by engagement between a notch or recess 138 formed between the legs 134 and an interfitting boss 140 on the cartridge frame. The flexible member 84 has a slot 142 therein through which a handle 124 of the tubing retainer extends. The tubing retainer 110 is discussed in greater detail below.

During operation of the pump 10, relatively high upward force is exerted on the occlusion bed 44, and the cartridge 16 is subject to vibration as well. To enable the adjustment mechanism 52 to be easy to operate without being subject to displacement in response to the force and vibration exerted on the occlusion bed, static friction is employed to provide rotational stability of the adjustment screw 58. To this end, each of the wedges 54 and 56 in the preferred embodiment has a small quantity of elastomeric material 100 disposed therein in contact with the adjustment screw 58 and pressed thereagainst to increase the static coefficient of friction.

As illustrated in FIG. 4, each of the preferred wedges 54, 56 has a bore 94 therein containing the elastomeric material. Each of the bores 94 extends from an exterior surface of the wedge to the bore 96 through which the adjustment screw 58 passes. The elastomeric material contacts the adjustment screw, and a set screw 98 is provided behind the elastomeric material 100 to permit maintenance of pressure thereon by periodic tightening of the set screw 98 as the elastomeric material wears or otherwise becomes less effective. To further increase static friction on the adjustment screw 58, a rubber bushing 102 is preferably provided in the bore 104 in the cartridge frame 36 through which the adjustment screw 58 passes. A large knob 106 with a knurled cylindrical exterior surface is employed to aid the user in overcoming the static friction to make adjustments.

The pump controller 30 contains a variable speed electric motor and a control circuit for adjusting the motor speed. The motor rotates a shaft coupled to the rotor 14. The rear end wall 24 of the pump frame has four screw holes therein, each with a counterbore for receiving a screw head. The screw holes align with threaded bores opening on the front surface of the pump control unit. A knob 108 enables manual adjustment of the pump speed.

During operation of a peristaltic pump, longitudinal force is exerted on the segment of tubing within the pump, tending to pull the tubing through the pump in the direction of rotation of the rotor. To prevent such displacement of the tubing, in some instances clips or stop are attached to the tubing for engagement with the exterior of the pump housing. In other cases, means are provided on the pump itself to constrain the tubing against longitudinal movement. In accordance with an aspect of the present invention, a novel and improved tubing retainer mechanism is provided on each cartridge.

As illustrated in FIG. 4, the tubing 18 for each cartridge passes over the outer rods 26, 28 which connect the forward and rearward walls 22 and 24 of the frame 12. To prevent longitudinal displacement of the tubing in response to pumping forces, each of the tubing retainers 110 exerts downward pressure on the tubing, holding it between a generally V-shaped notch 112 at the lower end of the tubing retainer and a respective one of the rods 26, 28. The V-shaped notch 112 has a corner edge thereon formed by the intersection at acute angle of a substantially vertical outer surface with a sloping, V-shaped bottom surface. The edge at the intersection has a radius of about 0.01 in. The dimension of the bottom surface in the direction of the length of the tubing is about 0.25 in.

Each of the tubing retainers 110 is constrained by an internal channel 114 in its associated side member 38 or 40 of the cartridge 16 so that it has one degree of freedom only, being movable only in linear vertical motion. Each of the illustrated tubing retainers 110 has an elongated body 128 extending into the channel 114. The body includes a pair of spaced legs 126 and 128 which extend vertically upward from the lower notched portion of the retainer, in sliding contact with the channel. The legs may be connected by a link (not shown) across their upper ends. To provide for manual control of the position of the retainer, and for locking of the retainer in a selected position, the retainer includes a cantilevered arm 116 having a plurality of teeth 118 thereon for engaging complementary teeth 120 on the interior of a slot 122. The slot 122 is disposed between the channel 114 and the exterior of the cartridge 16.

The arm 116 is made of a flexible, resilient material, and is movable between a first, undeformed position in which it is substantially vertical, and a second position in which it is deflected inward. When in its undeformed position, the arm 116 has its teeth 118 in locking engagement with the teeth 120 on the slot. When adjustment is desired, a projection 124 on the arm 116 is pressed inward by the user, deflecting the upper end of the arm 116 inward between the legs 126, 128 out of engagement with the teeth 120. The vertical position of the tubing retainer 110 may then be adjusted as desired. When the desired position is reached, the arm 116 need only be released and allowed to return to its undeformed position. This locks the retainer 110 in its new position.

The illustrated teeth 118 and 120 are configured to facilitate downward movement of the tubing retainer 110 and provide added mechanical resistance to upward movement, thereby avoiding unintended upward displacement of the tubing retainer due to pressure and pulsation attendant to the pumping operation. The internal channel 114 has relatively smooth sides, and is disposed in a different plane from the slot 122. This provides for smooth sliding of the tubing retainer when the arm 116 is depressed.

Stops 130 are provided on the interiors of the side members 28, 40 to limit downward travel of the occlusion bed. While the pump 10 is in use, upward pressure on the occlusion bed maintains the occlusion bed in place. When the cartridge 16 is removed from the pump 10, the stops 130 act to prevent the occlusion bed from being separated from the cartridge frame 36.

Figure 1:
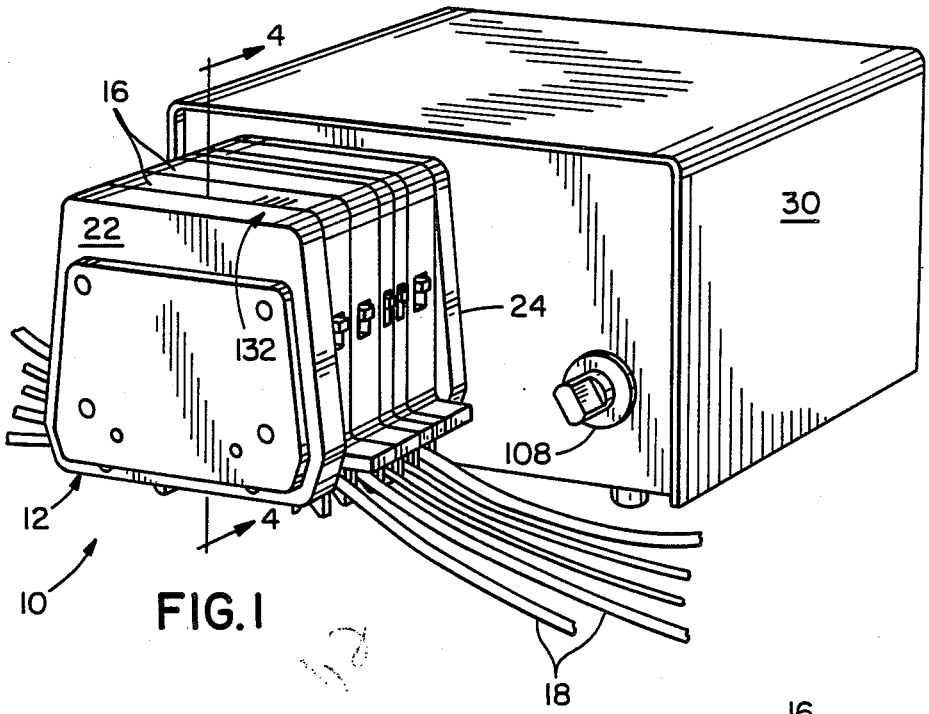
FIG. 1 is a perspective view of a pump in accordance with the invention.

Cartridges 16 of different sizes may be used simultaneously. In FIG. 1, three cartridges of one size are shown being used in combination with two cartridges of a smaller size. The smaller cartridges have approximately one-half the width of the larger cartridges, which permits simultaneous use of different sized cartridges on the pump frame without wasted space.

In determining the occlusion setting of the pump, several factors may be taken into consideration. First, the occlusion setting may be used to fine tune the flow rate. Increases in occlusion produce increases in output pressure and flow rate over a certain range, independent of the rotor speed. The degree of occlusion also affects the amount of pulsation in the flow rate. Additionally, increased occlusion decreases tubing life due to the increased strain experienced by the tubing with increased occlusion.

To enable visual determination of the occlusion setting while the pump is being operated, each of the wedges 54, 56 preferably is opaque and has vertical end surfaces which are visible through the top of the cartridge frame 36. To this end, the cartridge frame 36 is preferably made of a transparent plastic material such as Lexan. Indicia 132 may be provided on the top of the cartridge frame to enable comparison of wedge positions with predetermined reference points, thus facilitating repetition of occlusion settings. In the absence of indicia, the number of visible threads on the adjustment screw 58 adjacent each of the wedges may be viewed and counted from the top of the cartridge, providing a function similar to the aforementioned indicia.

From the foregoing it will be appreciated that the invention provides a novel and improved pump. The invention is not limited to the embodiments described herein above, or to any particular embodiment.

Figure 2:
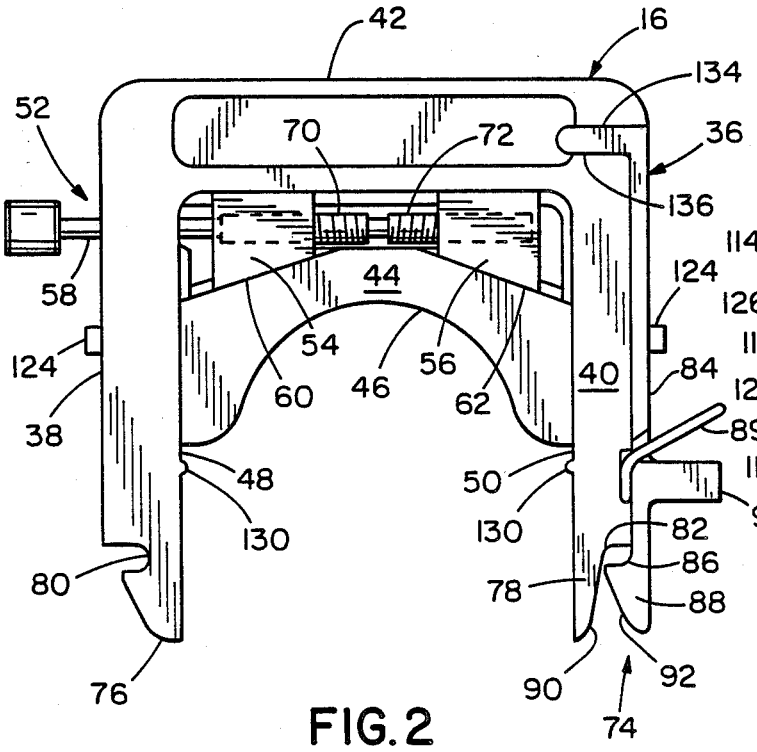
FIG. 2 is a front elevational view of a cartridge for the pump of FIG. 1.
Figure 3:
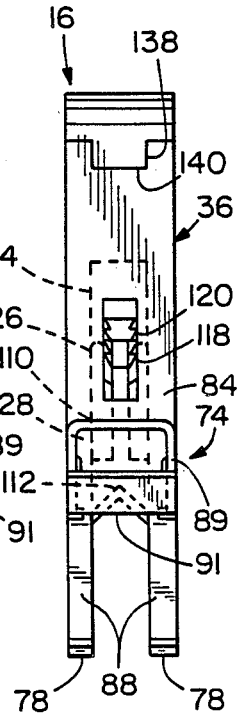
FIG. 3 is a side elevational view of the cartridge of FIG. 2.

As an alternative to the occlusion bed shown in the drawings, the occlusion bed may be hollow, and molded with an open top, so that the wedges engage upper edges of the forward and rear walls. In this embodiment, the occlusion bed would appear similar to that illustrated in FIGS. 2 and 4, except that the tongue-and-groove connection of the wedges and the occlusion bed would be reversed, with each of the wedges having a downwardly protruding tongue or ridge inserted in the open top of the occlusion bed. Other modifications to the above-described embodiment may also be made.

The invention is described with greater particularity by the following claims. It should be understood that the use of terms such as "horizontal", "vertical", etc. in the following claims is intended to describe only the orientation of the various components relative to one another. It is not intended to otherwise limit the claims with respect to the actual orientation of the pump components.

What is claimed is:

1. A peristaltic pump comprising:

a drive unit including a stationary frame and a rotor supported on said frame for rotation; and a plurality of removable cartridges disposed side-by-side on said drive unit;

said rotor having a generally horizontal axis and including rotatable support means and a plurality of elongated, parallel rollers, said rollers being carried by said rotatable support means in a circular path about the axis of the rotor, each roller further having its own axis of rotation and being rotatable thereabout;

each of said removable cartridges comprising a three-side cartridge frame which includes first and second generally vertical side members and a generally horizontal top member connecting said side members, a generally horizontal occlusion bed disposed between said side members and mounted in slidable engagement with the inner surfaces of said side members, and adjustment means for adjusting the position of said occlusion bed to enable precise selection of the degree of occlusion;

each of said removable cartridges being configured for cooperation with said drive unit so that for each cartridge a length of flexible tubing may be supported between the occlusion bed and the rotor to enable effectuation of peristaltic pumping of fluid through said length of tubing by rotation of said rotor;

each said occlusion bed having a pressure surface which approximately defines a radius about the axis of said rotor;

said adjustment means being operative to displace said occlusion bed in rectilinear motion.

2. A peristaltic pump in accordance with claim 1 wherein each of said cartridges further includes an indicator providing a visual indication of the position of said adjustment means to permit determination of the degree of occlusion by visual observation.

3. A peristaltic pump comprising:

a drive unit including a stationary frame and a rotor supported on said frame for rotation; and a plurality of removable cartridges disposed side-by-side on said drive unit;

said rotor having a generally horizontal axis and including rotatable support means and a plurality of elongated, parallel rollers, said rollers being carried by said rotatable support means in a circular path about the axis of the rotor, each roller further having its own axis of rotation and being rotatable thereabout;

each of said removable cartridges comprising a three-sided cartridge frame which includes first and second generally vertical side members and a generally horizontal top member connecting said side members, a generally horizontal occlusion bed disposed between said side members in slidable relation thereto, and adjustment means for adjusting the position of said occlusion bed;

said occlusion bed having at least one substantially planar, non-horizontal, upwardly-facing camming surface thereon, and said adjustment means including at least one wedge supported for horizontal displacement relative to said cartridge in sliding contact with said camming surface, and displacement means for varying precisely the position of said wedge, and thereby the position of said occlusion bed;

each of said removable cartridges being configured for cooperation with said drive unit so that for each cartridge a length of flexible tubing may be supported between the occlusion bed and the rotor to enable effectuation of peristaltic pumping of fluid through said length of tubing by rotation of said rotor;

each said occlusion bed having a pressure surface which approximately defines a radius about the axis of said rotor;

said adjustment means being operative to displace said occlusion bed in rectilinear motion;

said displacement means comprising a horizontal screw mounted for rotation on said cartridge frame and constrained against axial movement relative thereto, and a threaded bore disposed within said wedge in threaded engagement with said screw.

4. A peristaltic pump in accordance with claim 3 wherein each cartridge has means on its top member to permit viewing of at least a portion of at least one wedge, and indicia on said top member providing reference points with which the position of said wedge may be compared.

5. A peristaltic pump in accordance with claim 3 wherein each said wedge includes an elastomeric mass for frictionally engaging said screw and means for adjusting frictional force between said elastomeric mass and said screw.

6. A peristaltic pump comprising:

a drive unit including a stationary frame and a rotor supported on said frame for rotation; and a plurality of removable cartridges disposed side-by-side on said drive unit;

said rotor having a generally horizontal axis and including rotatable support means and a plurality of elongated, parallel rollers, said rollers being carried by said rotatable support means in a circular path about the axis of the rotor, each roller further having its own axis of rotation and being rotatable thereabout;

each of said removable cartridges comprising a three-sided cartridge frame which includes first and second generally vertical side members and a generally horizontal top member connecting said side members, a generally horizontal occlusion bed disposed between said side members in slidable relation thereto, and adjustment means for adjusting the position of said occlusion bed;

each of said removable cartridges being configured for cooperation with said drive unit so that for each cartridge a length of flexible tubing may be supported between the occlusion bed and the rotor to enable effectuation of peristaltic pumping of fluid through said length of tubing by rotation of said rotor;

each said occlusion bed having a pressure surface which approximately defines a radius about the axis of said rotor;

said adjustment means being operative to displace said occlusion bed in rectilinear motion;

said frame of said drive unit including a pair of rods extending substantially parallel to the axis of said rotor and each said cartridge including means near the lower ends of its side members for engaging said rods;

each said cartridge including a pair of tubing retainers, each tubing retainer being effective to engage a portion of a length of tubing to limit longitudinal displacement of said length of tubing, each said tubing retainer having a V-shaped notch therein with a corner edge for engaging said length of tubing and pressing said length of tubing against a respective one of said rods.

7. A peristaltic pump in accordance with claim 6 wherein each said tubing retainer has a plurality of teeth thereon and said cartridge frame has complementary teeth thereon, said teeth on said tubing retainer being selectively engageable with said teeth on said frame to permit stable positioning of said tubing retainer at a variety of locations relative to said frame.

8. A peristaltic pump in accordance with claim 7 wherein the teeth on each said tubing retainer are disposed on a flexible, resilient arm which is normally in a position providing engagement between the teeth on said tubing retainer and those on said frame, and which may be displaced to avoid such engagement and permit adjustment of the position of said tubing retainer.

9. A peristaltic pump in accordance with claim 8 wherein each of said cartridges is reversible relative to said pumping unit.

10. A cartridge for a peristaltic pump comprising a three-side frame which includes first and second generally vertical side members and a generally horizontal top member connecting said side members, a generally horizontal occlusion bed disposed between said side members in slidable relation thereto, and adjustment means for adjusting the vertical position of said occlusion bed relative to the cartridge frame;

said occlusion bed having a pressure surface having a predetermined internal radius over a major portion of its length;

said adjustment means being operative to effect reversible rectilinear displacement of said occlusion bed;

said occlusion bed having at least one substantially planar, non-horizontal upwardly-facing camming surface thereon; and said adjustment means including at least one wedge supported for horizontal displacement away from one of said side members toward the other of said side members in sliding contact with said camming surface, and displacement means for varying the position of said wedge and thereby the position of said occlusion bed;

whereby the cartridge, when in operation in combination with a pump frame and rotor, enables approximately uniform adjustments of occlusion along the pressure surface.

11. A cartridge in accordance with claim 10 further comprising means to permit visual determination of the position of the adjustment means by viewing the top of the cartridge.

12. A peristaltic pump comprising:

a stationary frame;

a plurality of cartridges supported by said stationary frame in side-by-side relation;

a plurality of tubing segments, each tubing segment being associated with a respective one of said cartridges;

a rotor supported on said stationary frame and acting in combination with said cartridges to effect peristaltic pumping action in said tubing segments, said roller including a plurality of rollers extending the length of said rotor and a plurality of guard members disposed between said rollers; and drive means for imparting rotation to said rotor;

each said cartridge comprising a three-sided cartridge frame which includes first and second generally vertical side members and a generally horizontal top member connecting said side members, a generally horizontal occlusion bed disposed between said side members in slidable relation thereto, and adjustment means for adjusting the vertical position of said d occlusion bed relative to the cartridge frame, said occlusion bed having a pressure surface having a predetermined internal radius over a major portion of its length;

each of said tubing segments being disposed between the rotor and the pressure surface of the occlusion bed of a respective one of said cartridges;

said adjustment means being operative to effect reversible rectilinear displacement of said occlusion bed so as to enable approximately uniform adjustments of occlusion along the pressure surface;

said stationary frame including stationary guard means extending beneath said rotor to partially shield said rotor.

* * * * *

UNITED STATES PATENT AND TRADEMARK OFFICE

CERTIFICATE OF CORRECTION

PATENT NO. : 4,886,431

DATED : December 12, 1989

INVENTOR(S) : Charles E. Soderquist and James P. Beck

It is certified that error appears in the above-identified patent and that said Letters Patent is hereby corrected as shown below:

Column 1, line 42: After "in" insert --a--.

Column 2, line 37: Change "Masterflex®" to --Masterflex®--.

Column 7, line 5, Change "side" to --sided--.

Column 9, line 18: Change "side" to --sided--.

Column 10, line 17: Change "roller" to --rotor--.

Column 10, line 28: After "said" delete "d".

Signed and Sealed this

Twelfth Day of February, 1991

*Attest:*

HARRY F. MANBECK, JR.

*Attesting Officer*

*Commissioner of Patents and Trademarks*